United States Patent [19]

Davis et al.

[11] Patent Number: 4,911,741

[45] Date of Patent: Mar. 27, 1990

[54] NATURAL GAS LIQUEFACTION PROCESS USING LOW LEVEL HIGH LEVEL AND ABSORPTION REFRIGERATION CYCLES

[76] Inventors: Robert N. Davis, R.D. #2 - Box 326, Breinigsville, Pa. 18031; Charles L. Newton, Bay Point Ct., Panama City, Fla. 32407

[21] Appl. No.: 249,044

[22] Filed: Sep. 23, 1988

[51] Int. Cl.[4] ..... F25J 1/02

[52] U.S. Cl. ..... 62/40; 62/476

[58] Field of Search ..... 62/40, 476

[56] References Cited

U.S. PATENT DOCUMENTS

| | | | |
|---|---|---|---|
| 2,862,049 | 3/1958 | Gilmore | 62/179 |
| 2,909,905 | 10/1959 | Mitchell et al. | 62/23 |
| 3,212,276 | 10/1965 | Eld et al. | 62/21 |
| 3,418,819 | 12/1968 | Grunberg et al. | 62/11 |
| 3,611,739 | 10/1971 | Bonem | 62/79 |
| 3,643,451 | 2/1972 | Foucar | 62/40 |
| 3,763,658 | 10/1973 | Gaamer et al. | 62/40 |
| 3,817,046 | 6/1974 | Aoki et al. | 62/40 |
| 4,054,433 | 10/1977 | Buffiere | 62/40 |
| 4,266,957 | 5/1981 | Isalsh | 62/40 |
| 4,350,571 | 9/1982 | Erickson | 62/40 |
| 4,525,195 | 6/1985 | Newton | 62/11 |
| 4,539,028 | 9/1985 | Paradowski et al. | 62/335 |
| 4,545,795 | 10/1985 | Liu et al. | 62/11 |
| 4,734,115 | 3/1988 | Howard et al. | 62/40 |

*Primary Examiner*—Ronald C. Capossela

*Attorney, Agent, or Firm*—Willard Jones, II; James C. Simmons; William F. Marsh

[57] ABSTRACT

The present invention is an improvement to a liquefaction process for natural gas, wherein refrigeration for the liquefaction process is provided by two closed-loop refrigeration cycles. The first or low level refrigeration cycle uses either a mixed refrigerant or a single component refrigerant as the heat pump fluid, and the second or high level refrigerant uses a mixed (multicomponent) refrigerant as the heat pump fluid. In the liquefaction process the second or high level refrigeration cycle cools the low level heat pump fluid. The low level refrigeration cycle cools and liquefies the cooled natural gas feed. The improvement to the process is the use of an absorption refrigeration cycle to precool the natural gas feed, the low level heat pump fluid, the high level heat pump fluid and, if required, the deep flash recycle. Heat to drive the absorption refrigeration cycle is provided by the exhaust gas from one or more drives for the compressors in the process.

18 Claims, 3 Drawing Sheets

NATURAL GAS LIQUEFACTION PROCESS USING LOW LEVEL HIGH LEVEL AND ABSORPTION REFRIGERATION CYCLES

TECHNICAL FIELD

The present invention relates to a process for the liquefaction of natural gas. More specifically, the present invention relates to a liquefaction process utilizing low level, high level and absorption heat pump cycles for cooling and liquefying the natural gas.

BACKGROUND OF THE INVENTION

Numerous processes are know for the liquefaction of gases such as natural gas. The following are among those the most pertinent references:

U.S. Pat. No. 4,545,795 discloses a process and apparatus for liquefying natural gas using two closed cycle, multicomponent refrigerants wherein a low level refrigerant cools and liquefies the natural gas and a high level refrigerant cools and partially liquefies the low level refrigerant. The high level refrigerant is phase separated in order to use lighter refrigerant components to perform the final lowest level of refrigeration while the liquid phase of the separation is split and then expanded for refrigeration duty in order to avoid multiple flash separations wherein heavier components are used to provide the lower levels of refrigeration.

U.S. Pat. No. 4,525,195 discloses an improvement to a process and apparatus for liquefying natural gas using two closed-cycle, multicomponent refrigerants; a low level refrigerant which cools the natural gas and a high level refrigerant which cools the low level refrigerant. The improvement to the process comprising phase separating the high level refrigerant after compression and fully liquefying the vapor phase stream against external cooling fluid after additional compression.

U.S. Pat. No. 3,812,046 discloses a process for liquefaction of natural gas which employs a multicomponent cooling cycle coupled ti an absorption refrigerant cycle. The invention uses the exhaust from a driver for compressors in the multicomponent cycle to effect warming in the absorption refrigeration cycle.

U.S. Pat. No. 3,763,658 discloses a method and refrigeration system for liquefying a feed stream by first subjecting the feed stream to heat exchange with a single component refrigerant in a closed, cascade cycle and thereafter, subjecting the feed stream to heat exchange with a multicomponent refrigerant in a multiple zone heat exchanger thereby forming a second, closed refrigerant cycle.

Additional information concerning refrigeration cycles or liquefaction processes are disclosed in U.S. Pat. No. 2,826,049; 2,909,905; 3,212,276; 3,418,819 and 3,611,739.

SUMMARY OF THE INVENTION

The present invention is an improvement to a liquefaction process for natural gas, wherein refrigeration for the liquefaction process is provided by a two closed-loop refrigeration cycles. The first or low level refrigeration cycle having either a mixed (multicomponent) or a single component refrigerant as the heat pump fluid, and the second or high level refrigerant having a mixed refrigerant as the heat pump fluid. In the liquefaction process the second or high level refrigeration cycle cools the the low level heat pump fluid and can optionally initially cool the natural gas feed. The low level refrigeration cycle cools and liquefies the cooled natural gas feed. Optionally, at least a portion of the liquefied natural gas can be flashed thereby forming a flashed stream; and at least a portion of that flashed stream would be recompressed and recycled back to the process as a deep flash stream. The improvement to the process is the use of an absorption refrigeration cycle to precool the natural gas feed, the low level heat pump fluid, the high level heat pump fluid and, optionally, the deep flash stream. Heat to drive the absorption refrigeration cycle can be provided by the exhaust gas from a drive for the compressors in the process.

DETAILED DESCRIPTION OF THE INVENTION

As stated earlier, the present invention is an improvement to a liquefaction process for natural gas, wherein refrigeration for the liquefaction process is provided by a two-closed loop refrigeration cycles. The first or low level refrigeration cycle having either a mixed (multicomponent, e.g. a mix of nitrogen, methane, ethane and propane) refrigerant as the heat pump fluid, and the second or high level refrigerant having a mixed or a single component (e.g., propane) refrigerant as the heat pump fluid. The refrigeration cycles can be any refrigeration cycles, e.g. cascade cycle, multiple zone heat exchange cycle, multicomponent phase separation cycle, etc.

In the liquefaction process the second or the high level refrigeration cycle cools the the low level heat pump fluid and can optionally initially cool the natural gas feed. The low level refrigeration cycle cools and liquefies the cooled natural gas feed. The improvement to the process is the use of an absorption refrigeration cycle to precool the natural gas feed, the low level heat pump fluid and the high level heat pump fluid. The preferred absorption refrigeration cycle is an ammonia-water absorption refrigeration cycle. Heat to drive the absorption refrigeration cycle can be provided by the exhaust gas from one or more drives for compressors in the process.

Figure 1:
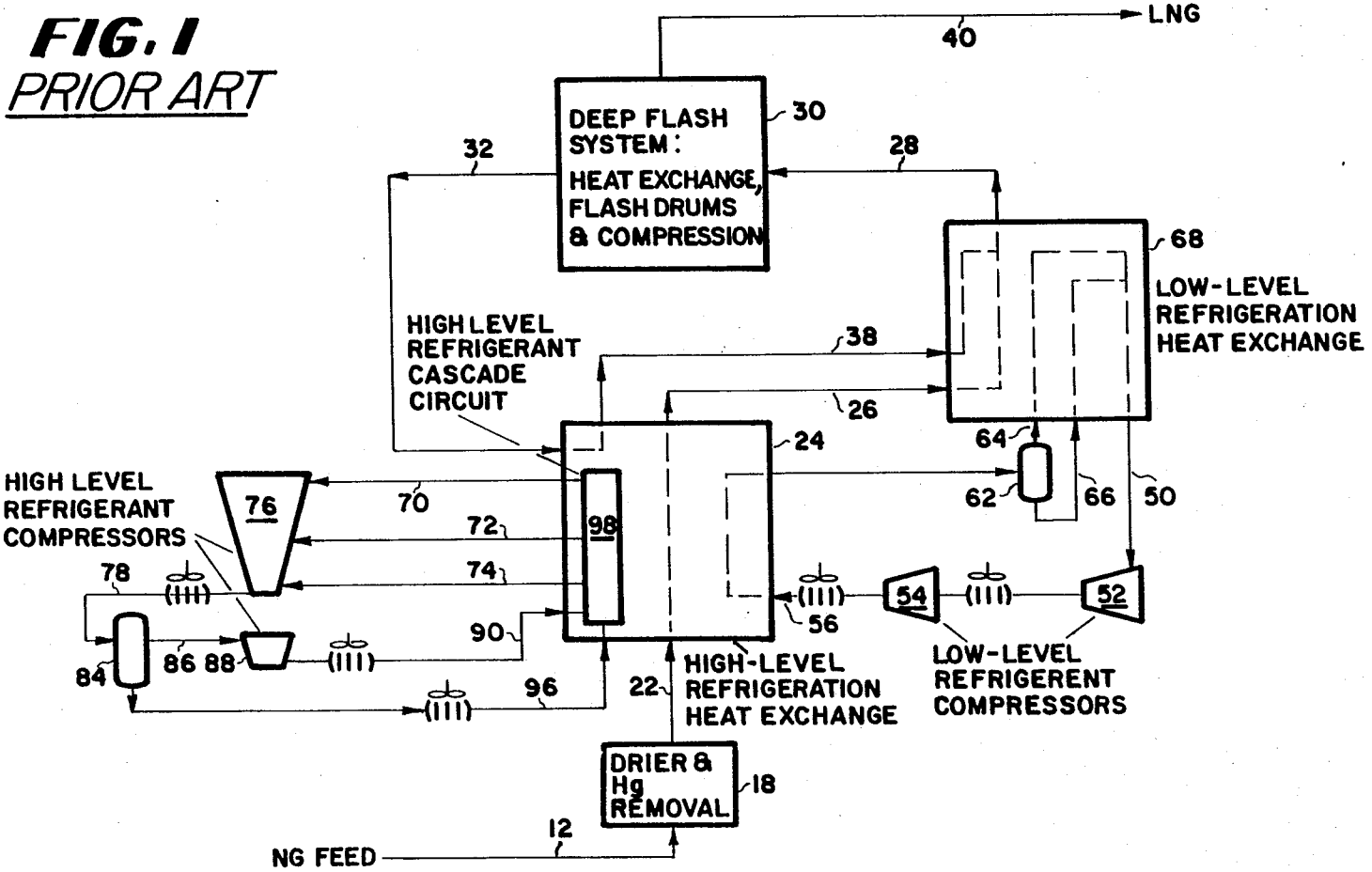
FIG. 1 PRIOR ART
FIG. 1 is a simplified flow diagram of a typical natural gas liquefaction process using two two closed loop, refrigeration cycles.

The present invention may be best understood in relationship to a typical natural gas liquefaction process known in the art. FIG. 1 illustrates such a process. With reference to FIG. 1, a natural gas feed stream, is fed to drier 18, via line 12 for removal of impurities which will freeze out at the cryogenic liquefaction temperatures. Numerous types of driers are known in the art and all known driers will work in the present invention. The dried natural gas is then optionally fed, via line 22, to high level refrigeration heat exchanger 24, wherein it is initially cooled. This initially cooled natural gas is then fed, via line 26, to low level refrigeration heat exchanger 68 wherein the natural gas feed stream is further cooled and condensed (liquefied). In heat exchanger 68, the natural gas feed stream in line 26 is united with the deep flash recycle stream in line 38, thereby forming a liquid natural gas stream.

This liquid natural gas stream is then fed, via line 28, to deep flash system 30, wherein the liquid natural gas stream is flashed in two stages producing two overhead flashed streams, the overhead flashed streams are reheated and recompressed, a portion of the recompressed flash is used to provide fuel to the process compression and the remaining portion of the recompressed flash, known as the deep flash, is cooled and liquefied by sequential cooling in heat exchangers 24 and 68. The liquid portion of the flashed streams is removed from deep flash system 30, via line 40, as liquid natural gas product.

Cooling for high level refrigeration heat exchanger 24 is provided by a mixed component (multicomponent) refrigerant or single refrigerant closed loop cycle. The high level refrigerant, which can be at varying conditions as shown in FIG. 1 lines 70, 72 and 74, is compressed in compressor 76. Compressor 76 can be a single compressor or a multiple stage compressor as the conditions require. The compressed high level refrigerant is aftercooled and phase separated in separator 84 to form an overhead stream and a liquid stream. The overhead from separator 84 in line 86 is compressed in compressor 88 and then fed, via line 90, to high level refrigerant cascade circuit 98. The liquid stream is fed to high level refrigerant cascade circuit 98, via line 96. In high level refrigerant cascade circuit 98, the mixed refrigerant is processed to provide refrigeration to precool the dried natural gas feed stream and cool the low level refrigerant. The processed mixed refrigerant streams are then recycled back to compressor 76, thus closing the cycle.

Refrigeration duty for low level refrigeration heat exchanger 68 is provided by a mixed refrigerant closed loop cycle. In the cycle, a multicomponent refrigerant in line 50 is compressed in compressors 52 and 54. This compressed low level refrigerant is the fed to, via line 56, and cooled in heat exchanger 24 wherein it is partially condensed. This condensed multicomponent refrigerant is the phase separated in separator 62. The overhead and bottom of separator 62 are fed, via lines 64 and 66, respectively, to low level refrigeration heat exchanger 68 for processing to provide refrigeration thereby liquefying the natural gas feed stream and deep flash recycle stream in lines 26 and 38, respectively. The processed overhead and bottom streams are then recombined to form line 50, thus closing the cycle.

Figure 2:
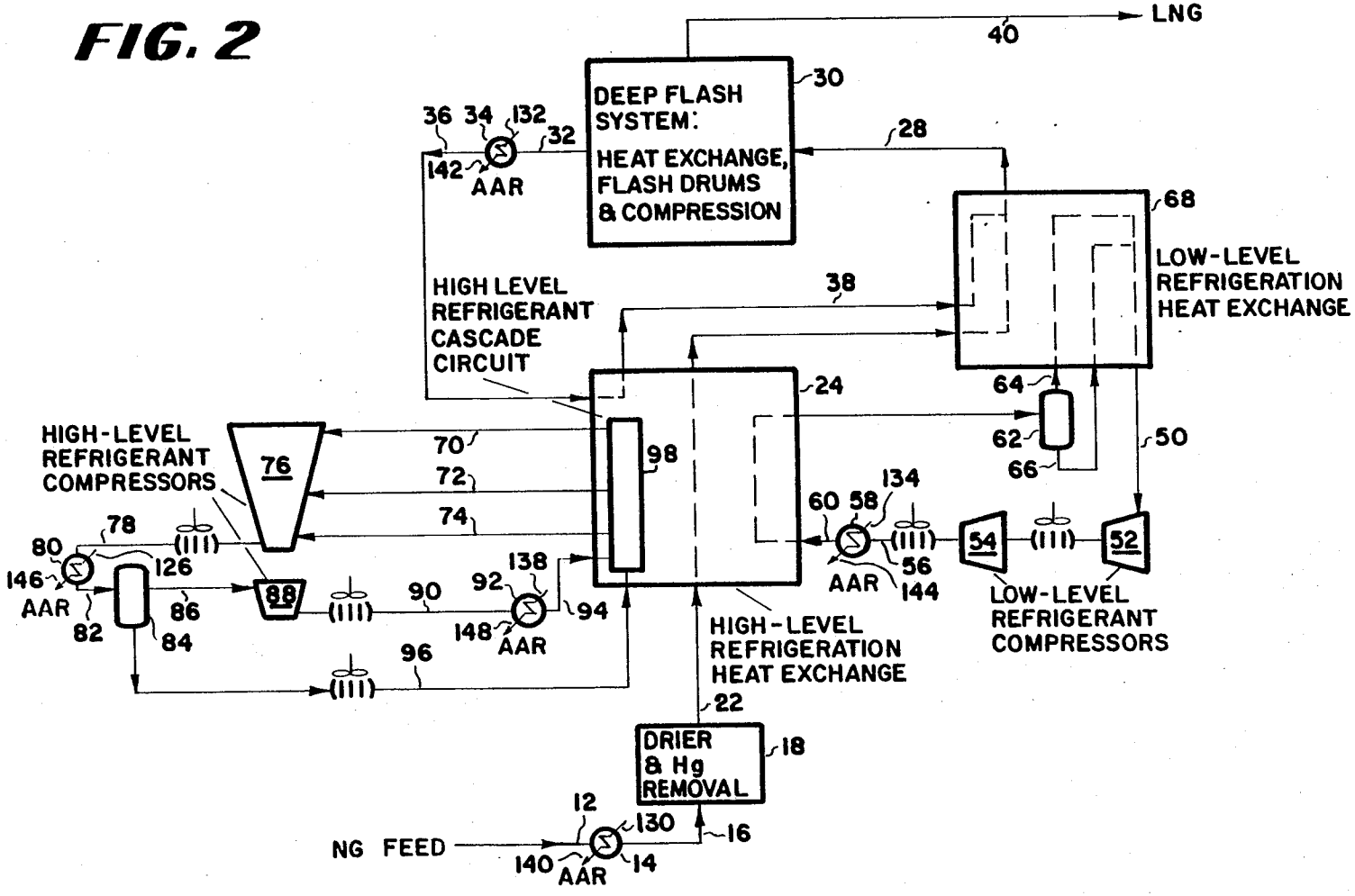
FIG. 2 is a simplified flow diagram of the process of the present invention which includes the absorption refrigerant cycle.

To further understand the present invention, the process of FIG. 1 has been modified to include an absorption refrigeration cycle, the process of the present invention; this improved process is shown in FIG. 2. In FIG. 2, process streams and equipment which are similar to FIG. 1 have been shown with identical numbers. With reference to the modifications in FIG. 2, the absorption refrigeration cycle provides initial precooling to the natural gas stream prior to drying (line 12), the low level refrigerant prior to heat exchange with the high level refrigerant in exchanger 24 (line 56), the deep flash recycle stream prior to heat exchange with the high level refrigerant in exchanger 24 (line 32), the compressed high level refrigerant prior to phase separation (line 78) and the compressed high level refrigerant overhead prior to being fed to exchanger 24 (line 90). This precooling could be conducted in heat exchangers 14, 58, 34, 80 and 92, respectively. The remainder of the process is the same as in FIG. 1.

Figure 3:
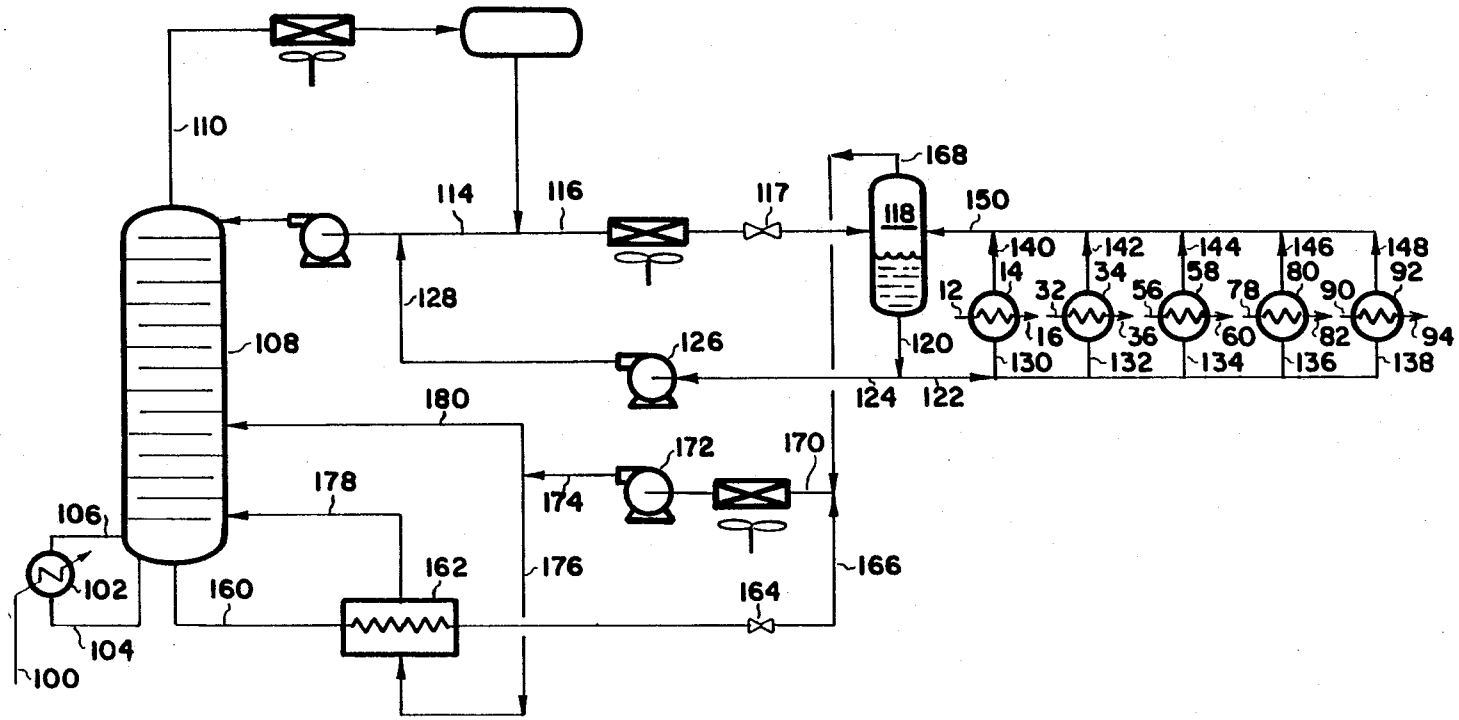
FIG. 3 is a flow diagram of the absorption refrigerant cycle showing the interaction between the cycle and the process of FIG. 2.

To better show the interaction between the absorption refrigeration cycle and the process of FIG. 2, FIG. 3 has been provided. FIG. 3 shows a standard ammonia-water absorption refrigeration cycle. With reference to FIG. 3, waste heat, for example, in the form of exhaust from the drive for the compressors in the refrigeration cycles, is fed, via line 100, to heat exchanger 102 wherein it used to heat and vaporize a portion of the bottoms liquid, in line 104, from ammonia-water distillation column 108. This warmed vapor is returned to column 108, via line 106. Overhead from column 108 is removed, via line 110, cooled thereby condensing the overhead and split into two portions. The first portion in line 114 is united with a portion of the liquid from the bottoms of separator 118 in line 128 and fed to the top of column 108 as reflux. The second portion in line 116 is subcooled, flashed and phase separated in separator 118.

The bottoms liquid or separator 118 is removed via line 120 and split into a major portion and a minor portion. The minor portion in line 124 is pumped up to pressure in pump 126 and united with condensed liquid overhead in line 114, via line 128. The major portion in line 122 is divided into five substreams. Substream 130 is fed to heat exchanger 14 to precool the natural gas feed in line 12. Substream 132 is fed to heat exchanger 34 to precool the deep flash recycle in line 32. Substream 134 is fed to heat exchanger 58 to precool the compressed low level refrigerant in line 56. Substream 136 is fed to heat exchanger 80 to precool the compressed high level refrigerant in line 78. Finally, substream 138 is fed to heat exchanger 92 to cool the compressed high level overhead in line 90. The warmed substreams, lines 140, 142, 144, 146 and 148, are recombined and fed to phase separator 118, via line 150.

The overhead from separator 118 is removed, via line 168 and combined with warmed flashed bottoms liquid in line 166, which is a portion of the bottoms liquid from column 108 in line 160 which is warmed in heat exchanger 162 and flashed across valve 164, to form stream 170. Stream 170 is cooled, pumped to pressure in pump 172 and divided into two intermediate reboil streams. The first intermediate reboil stream in line 176 is cooled in heat exchanger 162 and introduced to a lower portion of column 108, via line 178. The second intermediate reboil stream is fed to an intermediate location of column 108, via line 180.

To demonstrate the efficacy and benefits of the present invention, the processes of FIG. 1 and 2 are computer simulated. Table I provides a comparison of selected parameters for the two processes.

TABLE I

| Parameter | Process of FIG. 1 | Process of FIG. 2 |
|---|---|---|
| LNG production: MMSCFD | 340.0 | 381.84 |
| Compressor Power: Hp | | |
| Low Level Cycle | 56,390 | 55,020 |
| High Level Cycle | 57,527 | 54,588 |
| Deep Flash | 11,647 | 11,554 |
| Total | 125,564 | 121,162 |
| Specific power: Hp/MMSCFD | 369.3 | 317.3 |
| Mixed Refrigerant Composition: % | | |
| High Level | | |
| $C_1$ | 1.1 | 1.1 |
| $C_2$ | 38.9 | 50.0 |
| $C_3$ | 60.0 | 48.9 |
| Low Level | | |
| $N_2$ | 0.2 | 0.0 |
| $C_1$ | 45.7 | 43.5 |
| $C_2$ | 48.7 | 56.5 |

TABLE I-continued

| Parameter | Process of FIG. 1 | Process of FIG. 2 |
|---|---|---|
| $C_3$ | 5.4 | 0.0 |
| Exchanger UA × 1E 6 | | |
| High Level Total | 51.57 | 50.78 |
| Low Level Total | 38.44 | 29.50 |
| Available Waste Heat: MMBTU/hr | 709.2 | 609.4 |
| Adspt. Reboiler Duty: MMBTU/hr | 0.0 | 461.9 |
| Unused Waste Heat: MMBTU/hr | 709.2 | 147.5 |

As can be seen from the above table, comparing the specific power for each process, the process of the present invention is considerably more energy efficient than the prior art process; 16.4% more energy efficient. It should be noted that not all the waste heat was utilized, if it were, further improvement could be achieved.

To provide a further comparison of the process of the present invention versus other prior art processes, Table II is presented. In Table II, several prior art processes are listed along with the production capacity per the same amount of energy input based on input to gas turbines.

TABLE II

| Process | Production Capacity: % |
|---|---|
| FIG. 1 | 104 |
| FIG. 2 | 121 |
| U.S. Pat. No. 3,817,046 | 107 |
| U.S. Pat. No. 3,763,658 | 100 |
| U.S. Pat. No. 4,525,795 | 104 |
| U.S. Pat. No. 4,545,795 | 104 |

As can be seen from the above table, the process of FIG. 2, the process of the present invention on an energy efficiency basis is much superior to any of the prior art process.

Finally, there are some other notable advantages to the process of the present invention in addition to the increase in energy efficiency without the use of auxiliary firing. Among these are: the ability to control temperature in certain areas of the process so as to avoid the formation of hydrates; a stabilization of the high level precool compressor discharge pressure (i.e., constant precool temperature with varying ambient temperatures); more flexibility for machinery power utilization and arrangement (i.e., the ability to incrementally increase production for a given number and size of compressor drives); and can be easily retrofitted into a two closed-loop cycle liquefaction plant to increase production.

The present invention has been described with reference to a specific embodiment thereof. This embodiment should not be seen as a limitation of the scope of the present invention; the scope of such being ascertained by the following claims.

We claim:

1. In a process for the liquefaction of natural gas, wherein a natural gas feed stream is cooled and liquefied; refrigeration for the liquefaction process is provided by two closed loop refrigeration cycles; a first or low level refrigeration cycle, having a mixed (multicomponent) refrigerant heat pump fluid, cools and liquefies the natural gas feed stream; and the second or high level refrigeration cycle, having a mixed (multicomponent) refrigerant heat pump fluid, cools the low level heat pump fluid; the improvement for increasing the energy efficiency of the process comprises incorporation of an absorption refrigeration cycle to precool the natural gas feed, the low level heat pump fluid and the high level heat pump fluid.

2. The process of claim 1 wherein the absorption refrigeration cycle is an ammonia-water absorption refrigeration cycle.

3. The process of claim 1 wherein the process further comprises the high level refrigeration cycle cooling the natural gas feed stream prior to cooling with the low level refrigeration cycle.

4. The process of claim 1 wherein gas turbines provide the energy to compress the low level and high level heat pump fluid in the low level and high level refrigeration cycles and waste energy recovered from exhaust from the gas turbines drives the absorption refrigeration cycle.

5. In a process for the liquefaction of natural gas, wherein a natural gas feed stream is cooled and liquefied; refrigeration for the liquefaction process is provided by two closed loop refrigeration cycles; a first or low level refrigeration cycle, having a mixed (multicomponent) heat pump fluid, cools and liquefies the natural gas feed stream; the second or high level refrigeration cycle, having a mixed (multicomponent) refrigerant heat pump fluid, cools the low level heat pump fluid; at least a portion of the liquefied natural gas is flashed thereby forming a flashed stream; and at least a portion of the flashed stream is recompressed and recycled back to the process as a deep flash stream; the improvement for improving the energy efficiency of the process comprises incorporation of an absorption refrigeration cycle to precool the natural gas feed, the low level heat pump fluid, the high level heat pump fluid and deep flash stream.

6. The process of claim 5 wherein the absorption refrigeration cycle is an ammonia-water absorption refrigeration cycle.

7. The process of claim 5 wherein the process further comprises the high level refrigeration cycle cooling the natural gas feed stream prior to cooling with the low level refrigeration cycle.

8. The process of claim 5 wherein gas turbines provide the energy to compress the low level and high level heat pump fluid in the low level and high level refrigeration cycles and waste energy recovered from exhaust from the gas turbines drives the absorption refrigeration cycle.

9. In a process for the liquefaction of natural gas, wherein a natural gas feed stream is cooled and liquefied; refrigeration for the liquefaction process is provided by two closed loop refrigeration cycles; a first or low level refrigeration cycle, having a mixed (multicomponent) refrigerant heat pump fluid, cools and liquefies the natural gas feed stream; and the second or high level refrigeration cycle, having a single component refrigerant heat pump fluid, cools the low level heat pump fluid; the improvement for increasing the energy efficiency of the process comprises incorporation of an absorption refrigeration cycle to precool the natural gas feed, the low level heat pump fluid and the high level heat pump fluid.

10. The process of claim 9 wherein the absorption refrigeration cycle is an ammonia-water absorption refrigeration cycle.

11. The process of claim 9 wherein the process further comprises the high level refrigeration cycle cooling the natural gas feed stream prior to cooling with the low level refrigeration cycle.

12. The process of claim 9 wherein the single component heat pump fluid is propane.

13. The process of claim 9 wherein gas turbines provide the energy to compress the low level and high level heat pump fluid in the low level and high level refrigeration cycles and waste energy recovered from exhaust from the gas turbines drives the absorption refrigeration cycle.

14. In a process for the liquefaction of natural gas, wherein a natural gas feed stream is cooled and liquefied; refrigeration for the liquefaction process is provided by two closed loop refrigeration cycles; a first or low level refrigeration cycle, having a mixed (multicomponent) heat pump fluid, cools and liquefies the natural gas feed stream; the second or high level refrigeration cycle, having a single component refrigerant heat pump fluid, cools the low level heat pump fluid; at least a portion of the liquefied natural gas is flashed thereby forming a flashed stream; and at least a portion of the flashed stream is recompressed and recycled back to the process as a deep flash stream; the improvement for improving the energy efficiency of the process comprises incorporation of an absorption refrigeration cycle to precool the natural gas feed, the low level heat pump fluid, the high level heat pump fluid and deep flash stream.

15. The process of claim 14 wherein the absorption refrigeration cycle is an ammonia-water absorption refrigeration cycle.

16. The process of claim 14 wherein the process further comprises the high level refrigeration cycle cooling the natural gas feed stream prior to cooling with the low level refrigeration cycle.

17. The process of claim 14 wherein the single component heat pump fluid is propane.

18. The process of claim 14 wherein gas turbines provide the energy to compress the low level and high level heat pump fluid in the low level and high level refrigeration cycles and waste energy recovered from exhaust from the gas turbines drives the absorption refrigeration cycle.

* * * * *